US008848964B2

(12) United States Patent
Erdel

(10) Patent No.: US 8,848,964 B2
(45) Date of Patent: Sep. 30, 2014

(54) AUDIO-BYPASS, SAFETY EARBUD APPARATUS AND METHOD

(71) Applicant: Tammy Erdel, Draper, UT (US)

(72) Inventor: Tammy Erdel, Draper, UT (US)

( * ) Notice: Subject to any disclaimer, the term of this patent is extended or adjusted under 35 U.S.C. 154(b) by 0 days.

(21) Appl. No.: 13/722,418

(22) Filed: Dec. 20, 2012

(65) Prior Publication Data

US 2013/0163803 A1 Jun. 27, 2013

Related U.S. Application Data

(60) Provisional application No. 61/579,596, filed on Dec. 22, 2011.

(51) Int. Cl.

| | |
|---|---|
| ***H04R 25/00*** | (2006.01) |
| ***H04R 1/10*** | (2006.01) |
| *H04R 1/20* | (2006.01) |

(52) U.S. Cl.

CPC ..... *H04R 1/1091* (2013.01); *H04R 2460/09* (2013.01); *H04R 1/1016* (2013.01); *H04R 1/1058* (2013.01)

USPC ..... 381/373; 381/338

(58) Field of Classification Search

CPC ..... G10K 2210/1081; G10K 11/1788

USPC ..... 381/338

See application file for complete search history.

(56) References Cited

U.S. PATENT DOCUMENTS

| | | | | |
|---|---|---|---|---|
| D463,789 | S | 10/2002 | DeKalb et al. | |
| D463,790 | S | 10/2002 | Beraut et al. | |
| D467,907 | S | 12/2002 | Marion et al. | |
| D618,209 | S | 6/2010 | Andre et al. | |
| D619,566 | S | 7/2010 | Yu | |
| D641,010 | S | 7/2011 | Kwon | |
| 8,116,495 | B2 * | 2/2012 | Spaulding | 381/328 |
| 8,189,846 | B2 | 5/2012 | Tiscareno et al. | |
| 2008/0170740 | A1 | 7/2008 | Gantz | |
| 2008/0187161 | A1 * | 8/2008 | Tiemens et al. | 381/380 |
| 2009/0034775 | A1 | 2/2009 | Burton | |
| 2009/0245558 | A1 | 10/2009 | Spaulding | |
| 2011/0268308 | A1 | 11/2011 | Vasquez | |
| 2012/0207337 | A1 | 8/2012 | Tiscareno et al. | |
| 2012/0243726 | A1 * | 9/2012 | Hosoo et al. | 381/380 |

* cited by examiner

*Primary Examiner* — Brian Ensey
*Assistant Examiner* — Norman Yu
(74) *Attorney, Agent, or Firm* — Pate Baird, PLLC

(57) ABSTRACT

A fitting provided for earbud-type personal audio speakers may be formed as a homogeneous, integral component molded from an elastomeric polymer, such as silicone, urethane, or other elastomeric resins. A sleeve fitted to the speaker engages the fitting to the speaker, while ribs extending from the sleeve terminate in flutes conformal to an ear canal of a user. Axial insertion of the fitting and speaker into an ear of a user results in localized deflection of flutes and ribs in order to accommodate size and shape of an ear canal, resulting in transmission of sound from the speaker directly through the sleeve into an ear canal of a user, while also permitting environmental sounds to pass along a parallel path over the outside of the sleeve, between the ribs.

20 Claims, 8 Drawing Sheets

AUDIO-BYPASS, SAFETY EARBUD APPARATUS AND METHOD

RELATED APPLICATIONS

This application: claims the benefit of U.S. Provisional Patent Application Ser. No. 61/579,596, filed on Dec. 22, 2011; which is hereby incorporated by reference.

BACKGROUND

1. The Field of the Invention

This invention relates to sound speakers and, more particularly, to novel systems and methods for earbud-style, miniature or personal audio system speakers.

2. The Background Art

Music, podcasts, and other audio materials are now available to listeners. With the advent of the ipod™ and other MP3 audio players, individuals can carry with them gigabytes of data representing audio files for their listening desires. Personal audio devices have given rise to a plethora of speaker systems requiring very low power and fitted to a user. Such systems include headsets, earbuds, and the like. These speaker systems are very light weight, require very low power, and require very little space in most circumstances.

Pedestrians on the street, drivers in vehicles, and individuals at their work stations may often be found listening to their choice of music or other audio materials. This has become a traffic and safety issue in certain circumstances. For example, a pedestrian walking on a street needs to be aware of certain sounds in the environment. Public transportation agencies spend tremendous amounts of advertising dollars educating the public as to safety around mass-transit rail systems. An individual who cannot hear a coming commuter train, particularly quiet light-rail types of systems, may step into the path of a train, approach too close to the tracks, or otherwise be endangered because the speaker systems of an audio player block out other sounds.

Typically, a speaker system based on earbud technology includes a speaker that transmits sound directly into the outer ear channel of a user. Typically, a plug surrounds the central sound channel. Thus, not only is the sound directed immediately into the outer ear channel, other sounds are blocked out. Thus, the earbuds act not only as speakers but also as earplugs to cut out surrounding sound.

Thus, an individual who is listening to music or other audio materials not only has the volume of the sound obscuring any environmental sound sources but also has the effect of an ear plug blocking out any sounds other than those emanating from the speaker.

It would be an advance in the art to develop a speaker that is safer, by permitting bypass of certain sounds in order to allow a user to still detect environmental sounds affecting safety.

BRIEF SUMMARY OF THE INVENTION

In view of the foregoing, in accordance with the invention as embodied and broadly described herein, a method and apparatus are disclosed in one embodiment of the present invention as including an apparatus having flutes that fit within the outer channel of an ear of a user, having apertures between the flutes. A sound channel is typically directed along the center of the apparatus, with the flutes extending away therefrom in order to support the apparatus in the outer ear channel of a user.

Apertures are sized to provide passage of sounds having a wavelength suitable for safety. Thus, apertures may have one dimension of about ⅛ inch or less, and another dimension of over a ¼ of an inch to about ½ inch. Typically, the apparatus will be provided with a sleeve surrounding the sound channel. The sleeve fits over the housing of a speaker system. The speaker system may include a housing around a speaker itself, as well as a stem that transitions the electrical connections with electronics and eventually connects to a cord.

In certain embodiments, the housing may provide a shank adapted to secure into the sleeve. The speaker may contain electrically active elements operated in response to electrical signals passed through a cord into the speaker. The shank and the sleeve each surround the channel or lumen that carries sound from the speaker directly into the ear channel of a user. In some embodiments, the flutes may be supported and maintained a distance away from the sleeve in order to provide pressure against the inside surface of an outer ear channel of a user in order to maintain the apparatus firmly positioned.

In certain embodiments of apparatus and methods in accordance with the invention, a speaker may be provided having an interface specifically fitted to hold or secure a shank on the speaker. Deforming and resilience help interface between the comparatively harder plastic of a speaker and the comparatively softer and more sensitive tissue in an outer ear canal of a user. The shank includes a hollow center channel (lumen) that propagates sound waves into the interface. The interface may be thought of as a fitting that surrounds the speaker and provides the interface between a user and the speaker. Accordingly, the interface may typically be formed of a comparatively soft and flexible elastomeric polymer material. The speaker will typically be contained in a housing of comparatively harder and more rigid material, such as a metal, hard plastic, or the like.

In one contemplated embodiment, the interface (i.e. fitting) may include a sleeve configured as a cylindrical element having fins radiating outward therefrom and extending along at least a portion of the length of the sleeve. Each of the fins will typically terminate at its outermost radius by becoming, or terminating in, a flute.

By flute here is meant a broader based portion of material having a comparatively larger area in contact with an outer ear canal of a user. The flutes thus remediate the pressure that might otherwise be exerted by the comparatively narrower or thinner ribs. Thus, whereas a rib might exert a comparatively larger pressure over a smaller area, that same force will generate a comparatively smaller pressure over a larger area when passed through a flute to the skin lining the outer ear canal of a user.

The length of a fin along the sleeve, as well as the thickness circumferentially of the fin in a circumferential direction around the sleeve may be designed according to the size of the canal expected to be fitted by the fitting, and the pressure expected to be suitable for comfort for a user.

For example, the ribs may be formed of an expanded polymeric foam, such as an expanded elastomeric polymer material. Thus, the ribs may be comparatively softer and more flexible than the housing, instead approximating the tissue of the ear of a user. Moreover, the ribs may be comparatively thinner in the circumferential direction, and sized in thickness in an aspect ratio with radial height selected to initiate column buckling.

For example, a comparatively thinner rib will deflect by buckling, yet the flute, having a larger area in contact with an outer ear canal of a user may still remain oriented thereagainst. Accordingly, column buckling of the rib provides relief in the backing force urging each flute against the wall of the outer ear canal.

In certain embodiments, the polymer from which the interface is formed may be molded. For example, injection molding has been found suitable and various elastomeric materials have proven suitable. Elastomeric materials of those which maintain a certain resilience and deflect elastically, completely recovering upon removal of an applied stress. Polyurethane, silicone, and other synthetic elastomeric polymers have been found suitable.

The path of sound waves emanating from the speaker passes through the central canal of the shank and into the central canal of the interface. Thus, the interface directs sound waves directly into the outer ear canal of a user, toward the eardrum. Meanwhile, parallel paths are formed to propagate environmental sounds through channels formed by each pair of adjacent fins and the intervening portion of the sleeve. The outer wall in such a channel may be a combination of the flutes and the wall of the outer ear canal of a user.

In the contemplated embodiments, the dimensions for the thickness, length along the sleeve, and radial height from the sleeve to the flute for each rib may be selected to be identical to all others. In an alternative embodiment, these may vary. Nevertheless, in one currently contemplated embodiment, the interface may be made point symmetric having a plurality of ribs and their corresponding flutes, radially opposite one another about a circumference of the interface.

Accordingly, the characteristic length may include each dimension across or along a channel between the ribs. Characteristic lengths may relate to the frequency and wavelength of sound propagated. Thus, the channels may tend to filter out longer wavelengths that do not match the characteristic lengths (e.g., circumferential width, radial height, and axial length) of the bypass channels along the outside of the sleeve.

In certain embodiments, the flutes may be spaced apart to provide more or less distance therebetween. Meanwhile, the flutes may be sized in thickness to provide more or less distance therebetween. Nevertheless, it has been found effective to provide about twenty five percent of the circumferential distance in open space between flutes. This permits the flutes to move toward one another, closer together and the ribs to deflect to accommodate that deflection or movement by the flutes. Accordingly, the flutes maintain open the channels defined by the adjacent ribs and intervening sleeve in each case.

In some embodiments, the ribs may actually deflect circumferentially and tip over. To the extent, that a rib does so deflect, it may leave behind a channel nevertheless. Thus, the channels need not all be identical in shape or size about the entire circumference of the fitting.

In some embodiments, it has been found suitable to provide a rim interconnecting the flutes at their front end (insertion end) near the outlet of the sound channel of the sleeve, at the rear (speaker end) of the fitting, or both. In certain embodiments, it has been found that the deflection suitable for comfortable fitting of the interfacing fitting with the outer ear canal of a user is best served without a rim, or with rimless flutes that are free to move with the deflection of the ribs in multiple dimensions. In this way, no rim need remain to enforce the spacing between flutes. Accordingly, the flutes may move closer together with circumferential deflection of the ribs, thus providing stabilization, a comfortable fit, and channel maintenance. This buckling or distortion of ribs minimizes the force applied by the resilient ribs and flutes against the wall of the outer ear canal of user.

The fitting thus provides two parallel paths for sound. While orienting the shank (e.g., outlet channel) of the speaker to propagate sound waves directly into the outer ear channel of a user, the interface also establishes, defines, and provides outer channels. Environmental sound passes around the sleeve and speaker, through channels defined by adjacent ribs and their intervening sleeve portion. Sound waves propagate directly into the outer ear channel of a user.

It has been found that two significant properties affect the sound quality perceived by a user of the ear bud or personal earphone type of speakers. First, is providing a direct line of sound propagation from a speaker into an outer ear channel of a user. Second is occlusion or blocking of environmental sounds. However, in certain environments, environmental sound is critical to safety. Thus, by providing the environmental sound channels around the outside surface of the sleeve, and the propagated sound from speakers from the inside channel along the interior of the sleeve, both environmental and propagated audio sound are provided to a user.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 1:
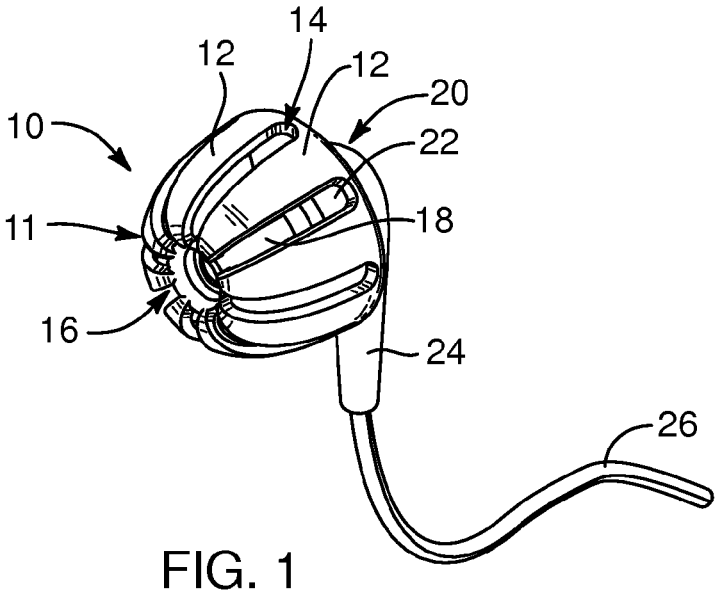
FIG. 1 is a frontal perspective view of one embodiment of an apparatus in accordance with the invention.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

Referring to FIGS. 1-8, while referring generally to FIG. 1-27, an apparatus 10 may include a speaker system having a fitting 11 adapting the speaker system 10 to fit within an outer ear channel of a user. In the illustrated embodiment, the fitting 11 may be formed to have flutes 12 acting to apply a force to a wall of the outer ear channel of a user or wearer of the apparatus 10.

In the illustrated embodiments, the flutes 12 of the fitting 11 may include apertures 14 formed in the flutes 12 of the fitting 11 or positioned between adjacent flutes 12. The apertures 14 provide a bypass region 14 in order that sound may pass through the fitting 11, past the apparatus 10, and into the ear of a listener. The apertures 14 thus provide a sound channel 14 for environmental sounds to bypass the apparatus 10, and reach a user. The apertures 14 thus do tend to pass filtered background sounds a means to bypass the fitting 11, thus rendering the fitting 11 no longer an ear plug as a sound deadening device.

An apparatus 10 provided with a fitting 11 presenting flutes 12 that are formed of a resilient material, such as a rubber, synthetic polymer, or other elastomeric material, provides a compressible fit within the outer ear of a user. Thus, the flutes 12 secure the apparatus 10, in place, by virtue of the compressibility of the flutes 12 of the fixture 11. Meanwhile, apertures 14 provided among the flutes 12 provide a bypass channel 14 in order to pass sound through the fitting 11 and apparatus 10 to the outer ear channel of a wearer or user.

A channel 16 is formed within a sleeve 18. The sleeve 18 is typically centrally located from the outer surface of the fitting 11. Typically, the outer surface of the fitting 11 is the outer surface of the flutes 12 themselves.

However, the flutes 12 may be formed in a variety of configurations in order to accomplish their functions. In some embodiments the flutes 12 may actually be constituted by a surface. In other embodiments, the flutes 12 may be narrower or wider and may be rib-like in their shape. Accordingly, such flutes 12 may fold, compress, or the like in order to deflect to fit within the outer ear channel of a wearer.

Meanwhile, the sound channel 16 is formed in the sleeve 18, and the sleeve 18 forms the central element connecting between the speaker 20 of the apparatus 10 and the outer ear channel of a user.

For example, the speaker 20 may be enclosed in a housing 22. The housing may typically be formed of a comparatively rigid or stiff polymeric material, such as a hard plastic. The housing 22 thus provides a degree of protection to the overall speaker system 20 or speaker 20.

By the same token, a stem 24 may form a transition member 24 between the housing 22, and a cord 26 carrying the electronic signals to the speaker 20. After conversion by the speaker 20 into audio waves or sound waves, the music or other material can be heard by a user after transmission through the channel 16 into the outer ear channel of the user.

The apertures 14 may be sized to have a width and a length of characteristic acoustic distances. The wavelengths that pass through openings are controlled by the dimensions of the openings that will permit those wavelengths to pass. Thus, an aperture 14 operates to a certain degree as a filter for sound. Sound waves that will be passed through air through the apertures 14 must have a wavelength less than the characteristic length defined by an aperture 14.

In operation, each fitting 11 fits into an outer ear channel of a user, and thus may be partially closed. Nevertheless, the clearance or relief provided between the flutes 12 and the sleeve 18, is bounded. The boundary is defined by the outer ear channel or the wall of the outer ear channel of a user. The flutes and ear wall define the passage opening the apertures 14 provide or enforce.

Referring to FIGS. 7-10, while continuing to refer generally to FIGS. 1-27, the sleeve 18 may fit around a portion of the housing 22 that houses the speaker 20. A housing 22 may have a shank portion 28, or a mount 28, that extends away from the larger portion of the housing 22 in which an actual speaker 20 is contained in the speaker system 20. Typically, the shank 28 is slightly larger than the internal diameter of the sleeve 18. Thus, the sleeve 18 may form a friction fit around the shank 28. This maintains the sleeve 18 and the resulting fitting 11 of the apparatus 10 firmly secured to the shank 28. In certain embodiments, a relief, detent, or other interference on the shank 28 may interact with a corresponding portion in the side the sleeve 18. This provides an affirmative grip or securement of the sleeve 18 on the shank 28.

Figure 2:
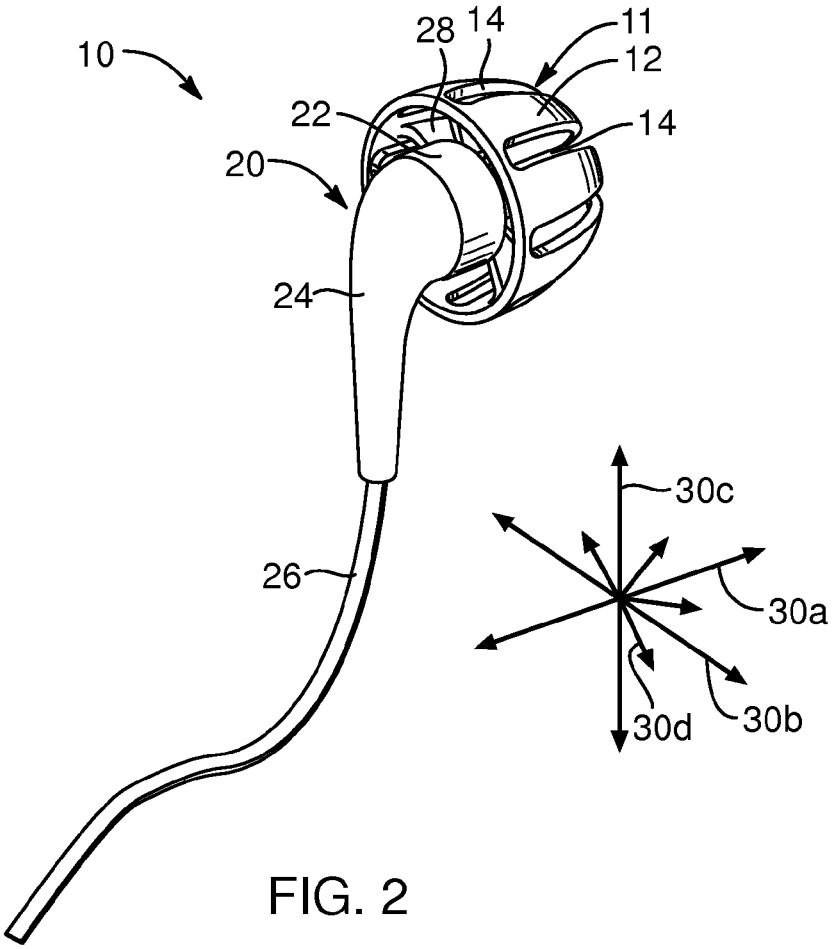
FIG. 2 is a rear perspective view thereof.
Figure 3:
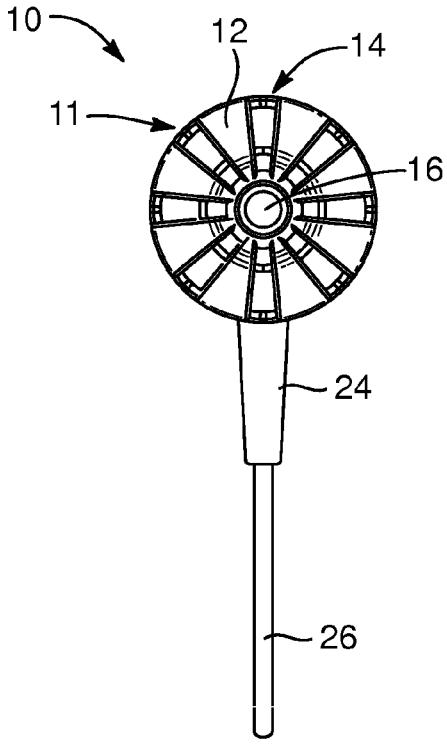
FIG. 3 is front elevation view thereof.
Figure 4:
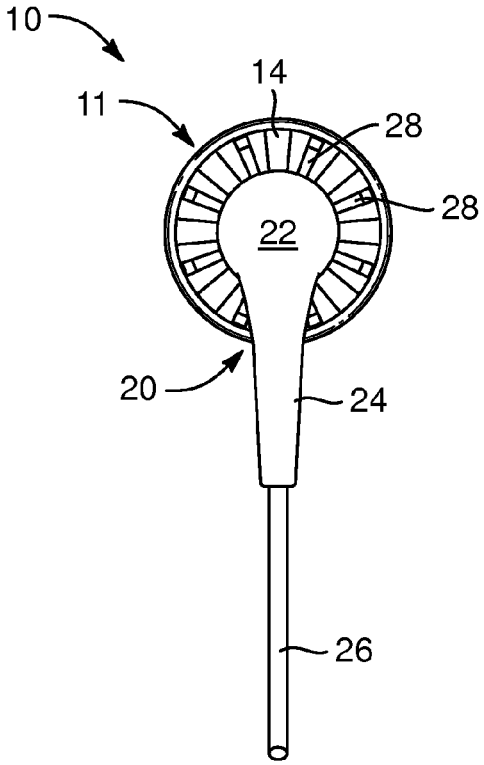
FIG. 4 is a rear elevation view thereof.
Figure 5:
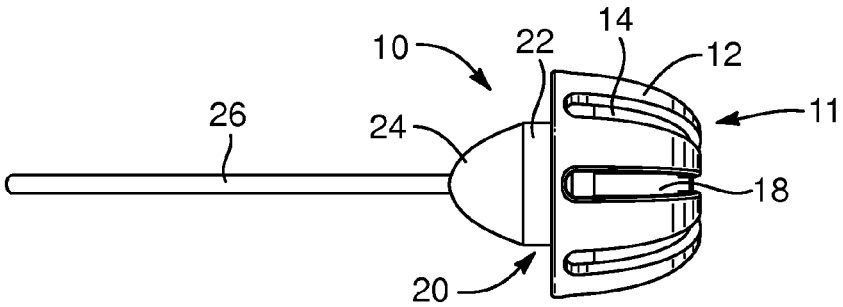
FIG. 5 is a top plan view thereof.
Figure 6:
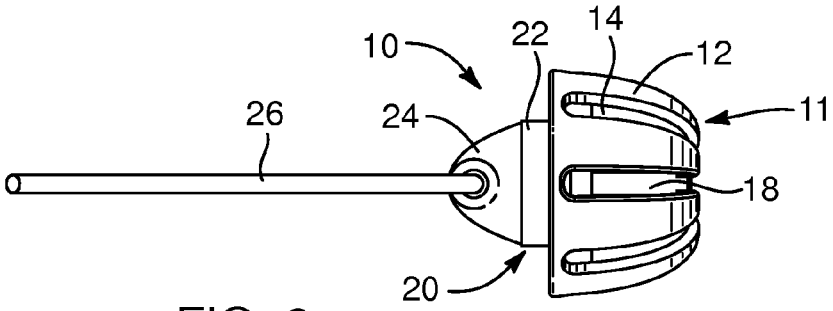
FIG. 6 is a bottom plan view thereof.
Figure 7:
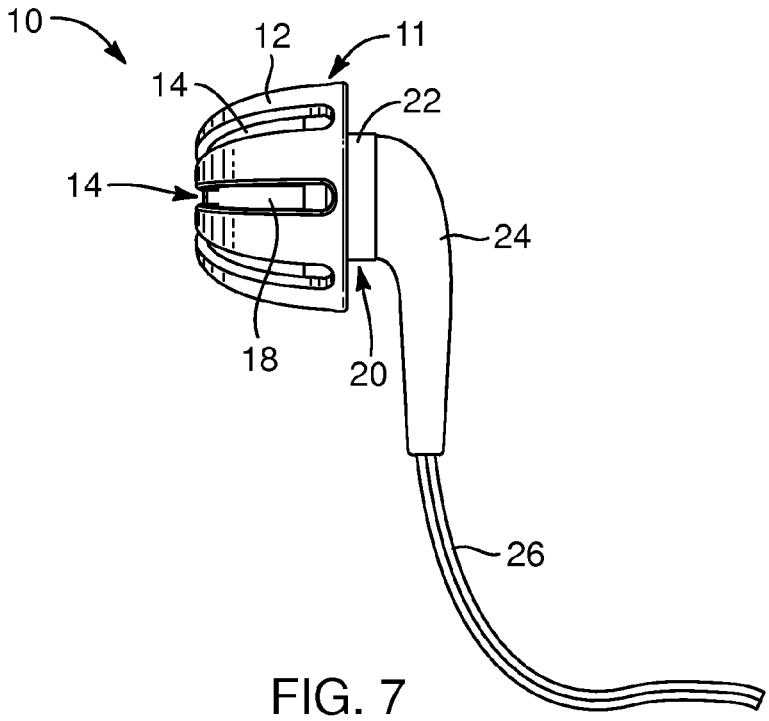
FIG. 7 is a right side elevation view thereof.
Figure 8:
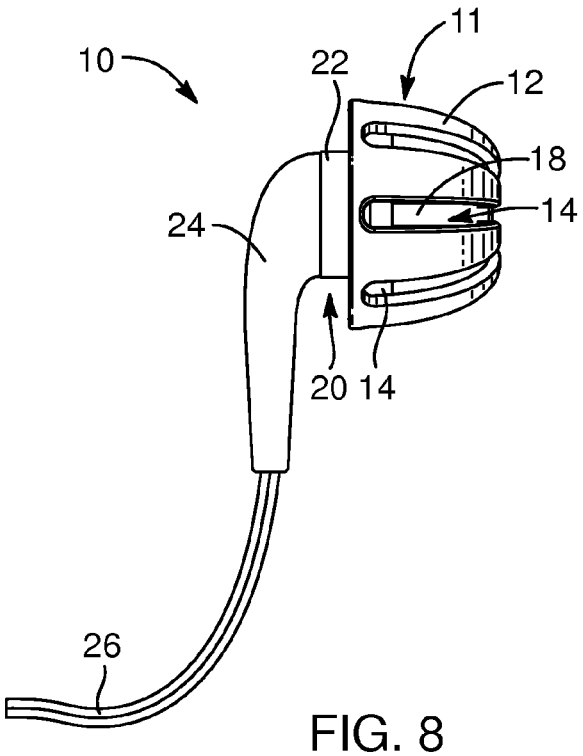
FIG. 8 is a left side elevation view thereof.
Figure 9:
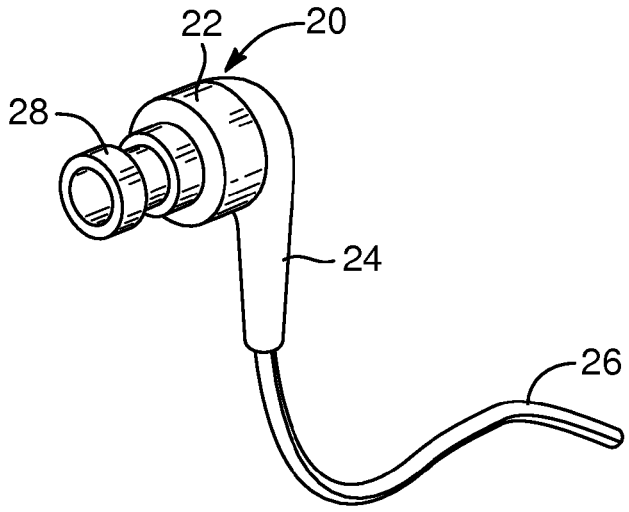
FIG. 9 is a front perspective view thereof one embodiment of speaker housing system.
Figure 10:
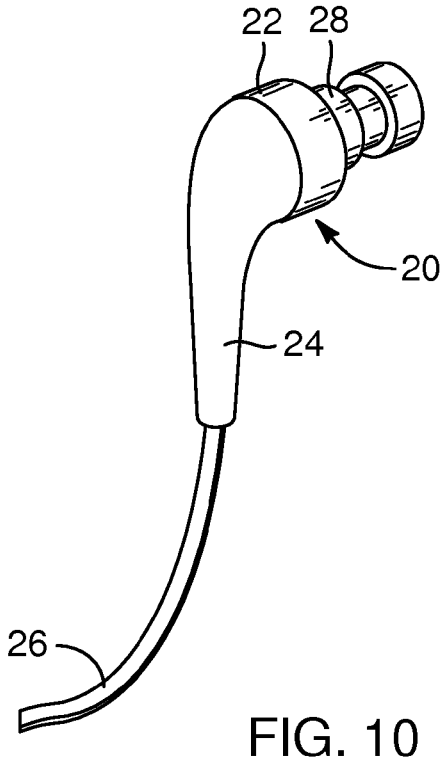
FIG. 10 is a rear perspective view thereof suitable for securing a fitting such as the audio-bypass safety earbud fitting.

In general, the directions 30 of FIG. 2, defining the apparatus 10 and its use with respect to a wearer, may be defined as an axial direction 30*a* that effectively runs parallel to the channel 16 and down the center of the sleeve 18 as well as the center of the shank 28. This forms the axis along which the audio waves are transmitted from the speaker 20 into the ear of a wearer.

Likewise, a lateral direction 30*b* may be thought of as a horizontal direction, nominally, while a transverse direction 30*c* may be thought of as a nominal vertical direction. Nevertheless, both the lateral direction 30*b* and the transverse direction 30*c* are actual radial directions 30*d*. A radial direction 30*d* is orthogonal to the axial direction 30*a* but may go in any direction around a full 360 degrees in a plane, any plane, perpendicular to the axial direction 30*a*.

Accordingly, ribs 32 formed behind the flutes 12, or as a supporting portion of a flute 12, or in some embodiments as the structure of the flute 12, maintain an outer surface against the inner surface of the outer ear channel of a user.

For example, in the embodiments of FIGS. 1-8 and 17-27, the ribs 32 may serve as spacers or supports for the flutes 12. Thus, the ribs 32 extend between the sleeve 18 and the flutes 12. Thus, the ribs 12 each provide a column 32 that may apply a force to the flutes 12, thus urging the flutes 12 to fit snugly against the inside surface of the wall of an outer ear channel of a user.

The ribs 32 may be formed of a suitable material, and typically will be homogeneously molded with the sleeve 18 and flutes 12 as a monolithic, integrated, and homogeneous construction. Nevertheless, the apparatus 10 may be assembled, and even the fitting 11 may be assembled. It may be productively manufactured in a molding process as a single integrated piece 11.

Referring to FIGS. 11-27, while continuing to refer generally to FIGS. 1-27, various alternative embodiments for a fitting 11 of an apparatus 10 may include variations in the size, shape, orientations, positions, and the like of the flutes 12 and their intermediate apertures 14.

Figure 11:
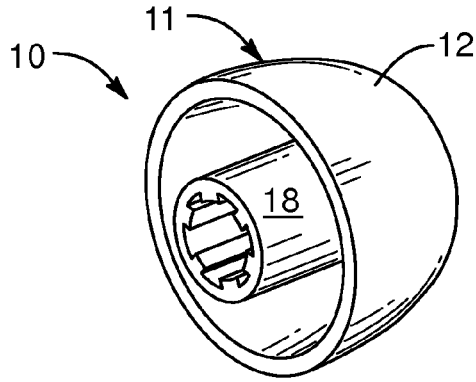
FIG. 11 is a rear perspective view of an alternative embodiment of a sleeve of a fitting in accordance with the invention.

Referring to FIG. 11, various mechanisms for securement may be provided. In this embodiment of a fitting 11, a sleeve 18 is centered within the fixture 11. The flute 12 is shown as an entirely enclosed surface. Nevertheless, the embodiment of FIG. 11 illustrates a shaping of the interior channel 16 of the sleeve 18 in order to provide easier deflection, and yet a gripping by the sleeve 18 against the shank 28 of a housing 22. The outer surface or material of the fitting 11 may be perforated with apertures 14 according to any or all of the suitable embodiments illustrated, for example, that of FIG. 12.

Figure 12:
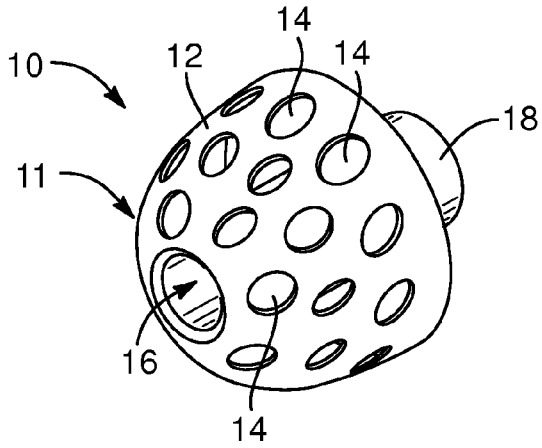
FIG. 12 is a frontal perspective view of a fitting having discrete apertures distributed over the outer wall of the fitting.

Referring to FIG. 12, in one embodiment of an apparatus 10 in accordance with the invention, the flutes 12 are actually simply the material of the fitting 11. The fitting 11 is, provided with apertures, discretely positioned and separated from one another. Thus, the sleeve 18 and the sound channel 16 through the fitting 11 operate in accordance with the other embodiments illustrated herein.

Figure 13:
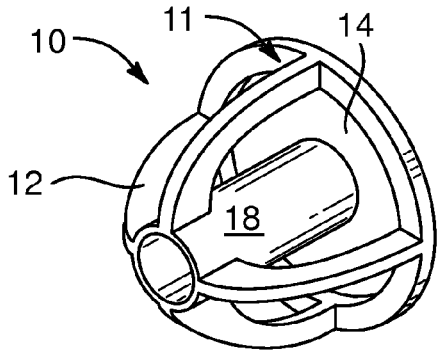
FIG. 13 is a front perspective view of an alternative embodiment of a fitting in accordance with the invention.
Figure 14:
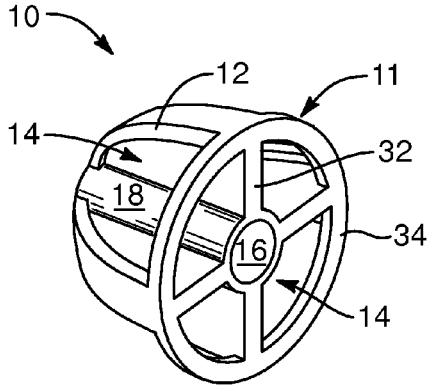
FIG. 14 is a rear perspective view thereof.

Referring to FIGS. 13-14, the flutes 12 may be spaced a substantial distance apart. For example, the illustrated embodiments of FIGS. 13-14 show alternative mechanisms for supporting the flutes 12 spaced away from the sleeve 18. In the embodiment of FIG. 13, no ribs 32 are shown.

However, in the embodiment of FIG. 14, ribs 32 space the flutes 12 a distance away from the sleeve 18. The ribs 32 each form a support member 32 that may flexibly urge each of the corresponding flutes 12 into contact against the surface of an outer ear channel of a wearer.

Figure 15:
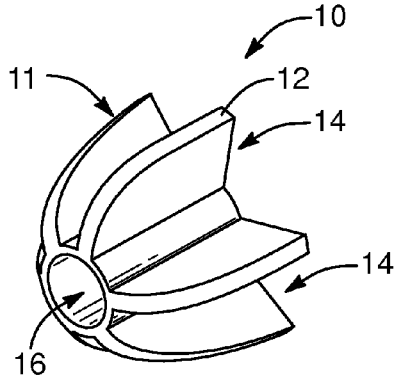
FIG. 15 is a front perspective view of an alternative embodiment for a fitting in accordance with the invention.
Figure 16:
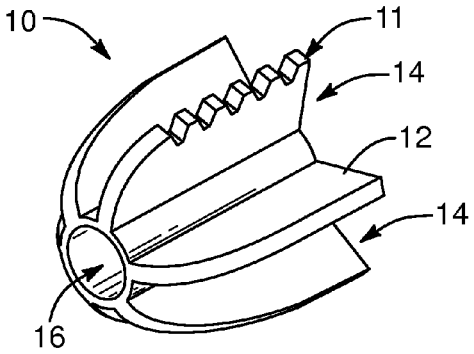
FIG. 16 is an alternative embodiment thereof, using a serrated or undulating edge on selected flutes thereof.

Referring to FIGS. 15-16, flutes 12 may be separated from one another, and each may emanate, by extending in a radial direction 30*d*, away from the center sleeve 18. In the illustrated embodiment, the convergence of the individual flutes 12 actually forms the central sleeve 18. The sleeve 18 then may or may not be discretely identifiable separate from the flutes 12, as the sleeve 18 defines the sound channel 16.

Referring to FIG. 16, the flutes 12 in one embodiment may be serrated along their edges in order to provide a more gripping surface. For example, by having a serrated edge on one or more of the flutes 12, areas of higher and lower pressure alternate. Thus, the tendency is for a greater resistence to sliding. That is, each area of higher compression corresponds to an area of a higher tooth on the serrated edge of a flute 12. In this manner, the tooth has a larger incursion in depressing the outer ear channel wall against which it fits, leaving less depression in the areas or valleys between the teeth (or crests) of the serrations. Thus, greater support against axial movement may be achieved.

Figure 17:
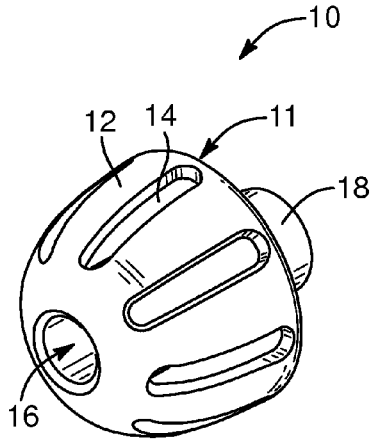
FIG. 17 is a perspective view of a one embodiment of a fitting in accordance with the invention.

Referring to FIG. 17, the embodiment of FIG. 17 may or may not include ribs 32 as illustrated in FIGS. 1-8. In this embodiment, as in the embodiment of FIG. 13, a stiffer material may not benefit as much from the presence of ribs 32. Likewise, manufacturing may be somewhat simpler. Nevertheless, a substantially softer material, even a foamed elastomeric material, may be used to mold many of the embodiments of fittings 11, thereby providing sufficient flexibility for comfort. Meanwhile, ribs 32 may act as stiffeners. A rib 32 provides additional radial force. Ribs 32 act as supports, stabilizers, or the like in order to maintain the distance, spacing, or he like. Ribs 32 enforce, under pressure, the original tendency of flutes to stay spaced apart from the sleeve 18 and from the other flutes 12.

Referring to FIGS. 18-27, while continuing to refer generally to FIGS. 1-27, a fitting 11 may take on various configurations suitable to the material selected and the comfort of a user. For example, radial supports, such as ribs 32, may apply force in a radially outward direction against a flute 12, on the outside. They may apply corresponding force against the sleeve 18 located on the inside thereof Likewise, circumferential support may be provided by and actually may deflect the flutes.

Figure 18:
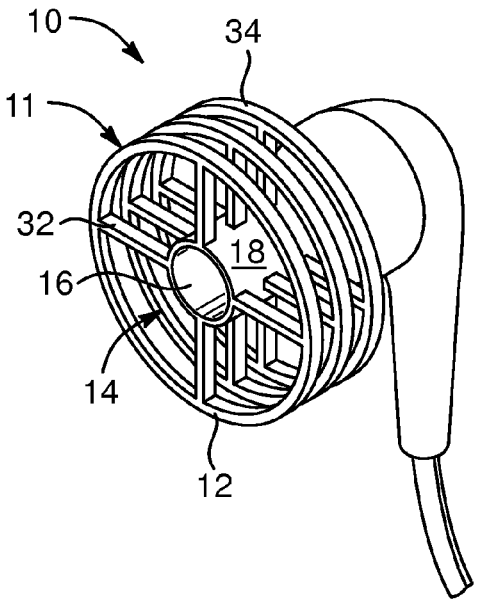
FIG. 18 is a frontal perspective view of an alternative embodiment of a fitting in accordance with the invention.

Referring to FIG. 18, for example, the flutes 12 extend circumferentially around the sleeve 18, spaced away from the sleeve 18 by the ribs 32. Meanwhile, the flutes 12 have a convoluted shape that varies in diameter and radius as the flutes progress along the axial direction 30*a*. Thus, one or more ribs 32, which may or may not be continual in the axial direction, space the sleeve 18 from the flutes 12, and represent a somewhat convoluted outer surface. Thus, in this embodiment, as in the embodiment of FIG. 16, alternating areas of higher pressure and lower pressure tend to provide additional gripping against axial dislodgement of the apparatus 10.

Figure 19:
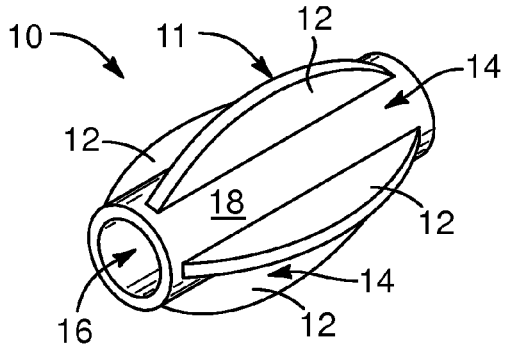
FIG. 19 is an alternative embodiment of a fitting having flutes without a surrounding rim.

Referring to FIG. 19, an embodiment having no outer rim for the flutes 12, but simply the flutes 12 themselves, are effectively like ribs 32. They extend from the sleeve 18 and contact directly the surface of the outer ear channel of the wearer. In this embodiment, the edge of each flute 12 itself may fit against the ear channel of a user, and maintain the sleeve 18 against dislodgement. In this embodiment, a stiffer material may be needed than in certain of the other embodiments, where more surface area, more material, and more contact area are provided.

However, in this embodiment, the aperture region 14 is substantial, and effectually is most of the projected area of the entire fitting 11. That is, for example, proceeding in an axial direction 30*a*, the majority of the cross-sectional area circumscribed by the envelope around the fitting 11 is the aperture region 14 itself. Only the four flutes 12, which could be three flutes 12 in certain embodiments, or another number, actually represent spacing and structure between the sleeve 18 and the wall of the outer ear channel.

Figure 20:
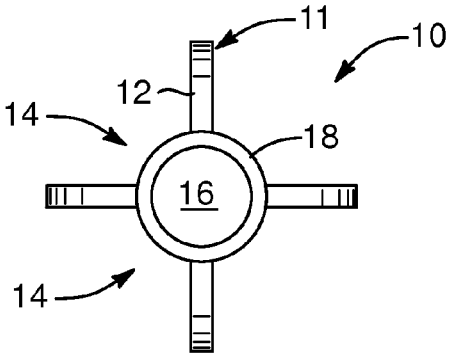
FIG. 20 is a front elevation view thereof.

Referring to FIG. 20, in one embodiment, as illustrated in FIG. 19, the flutes 12 may compress, deflect, or otherwise change shape in order to fit within the ear channel of a user. In the illustrated embodiment, two of the flutes 12 maintain substantially their shape, while two others are deflected or distorted in order to fit in the ear channel of the wearer.

Figure 21:
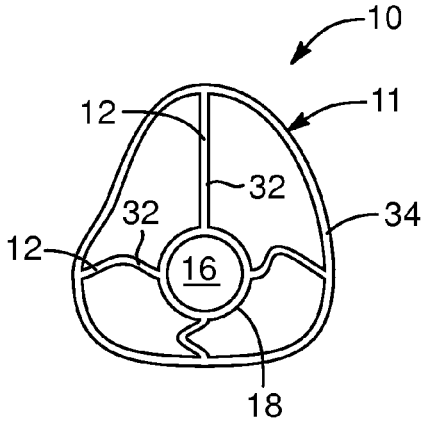
FIG. 21 is a front elevation view of the apparatus of FIG. 18, showing distortion that may typically occur when positioned in place
Figure 22:
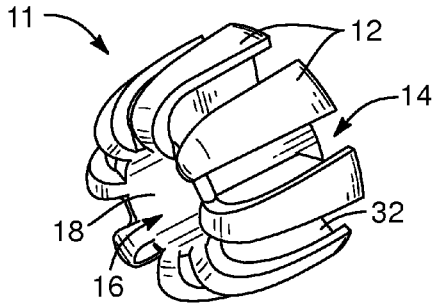
FIG. 22 is a frontal perspective view of one embodiment of an apparatus in accordance with the invention.
Figure 23:
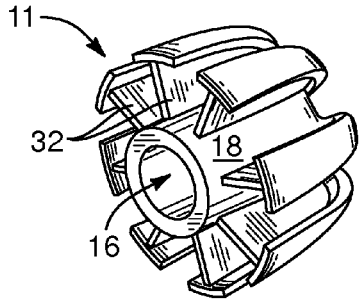
FIG. 23 is a rear perspective view thereof.
Figure 24:
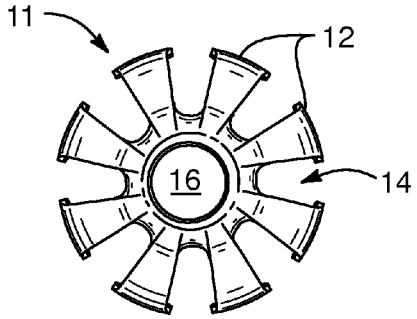
FIG. 24 is front elevation view thereof.
Figure 25:
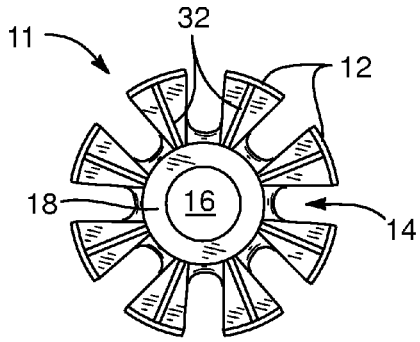
FIG. 25 is a rear elevation view thereof.
Figure 26:
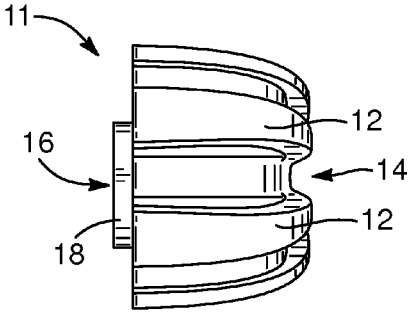
FIG. 26 is a top plan view thereof, the bottom plan view being the same.
Figure 27:
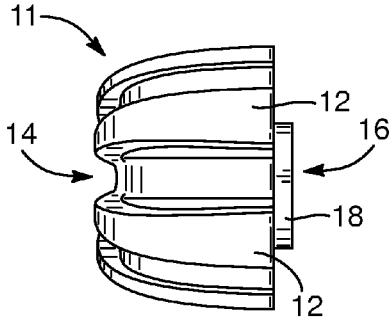
FIG. 27 is a right side elevation view thereof, the left side elevation view being a minor image thereof about any vertical plane extending into the page to the left or right of the image.

Referring to FIG. 21, similarly, the embodiment of FIG. 18 shows the flutes 12 that basically rely on the rim 34 around the ribs 32. All may deflect selectively in order to fit within the outer ear channel of a user. Thus, a rim 34 may be desirable to maintain a certain amount of stability between the ribs 32 that together with the rim 34 actually form the flutes 12 or the structure 12 that axial flutes 12 would otherwise provide.

Referring to FIGS. 22-27, while continuing to refer generally to FIGS. 1-27, a speaker system 10 may be provided with a fitting 11 (i.e., interface) suitable for interfacing between an outer ear canal of a user and the speaker system 20 of an audio device. In the illustrated embodiment, the rim 34 is noticeably absent between the adjacent ribs 32 and flutes 12. In this embodiment, it has been found effective to provide a fitting 11 having flutes 12 surrounding the sleeve 18. Each flute 12 is supported by a rib 32 extending radially between the sleeve 18 and the corresponding flute 12.

The material of which the fitting 11 is molded or cast may be any suitable material, but an elastomeric polymer material has been found most suitable. For example, silicone compounds have been found suitable, and sufficiently durable. Meanwhile, they have sufficient softness (e.g., by durometer test value) and flexibility (e.g., by mechanical stiffness and deflection underload) to match mechanical properties of, fit well into, the outer ear canal of a user in the dimensions illustrated.

In other embodiments in which a rim 34 interconnects the ribs 32 or flutes 12 of the fitting 11, a conservation-of-mass principle as well as the mechanical stiffness of the rim 34 and rib 32 combination tends to stabilize the flutes 12 more than necessary. Inasmuch as the shape of the flutes 12 is fitted to contact the surface of the skin lining the outer ear canal of a user, the flutes 12 tend to stabilize within the ear channel.

Meanwhile, deflections as required may occur in the flutes 12. Of particular note, the ribs 32 are made to have a thickness and height (height measured radially from the sleeve 18) to be sufficiently flexible to engage in column buckling. To the extent that the fitting 11 needs to deform or deflect to fit inside the outer ear canal, that deflection may be provided by buckling of one or more of the ribs 32. By buckling, the ribs 32 necessarily displace into the channels 14 between the ribs 32. Nevertheless, to the extent that a rib 32 occludes part of a channel 14, it will tend to open up the adjacent channel 14 on the opposite side of the rib 32.

In the illustrated embodiment, it has been found that comfort, fit, and ease of application are all well served by the fitting 11 made in accordance with the illustrated embodiment, and lacking any rim 34 interconnecting the flutes 12. One may form the ribs 32 to be of any suitable thickness and height, depending on comfort for the wearer. That is, for example, the thickness of the ribs 32 will influence the effective pressure exerted by the ribs 32 on the flutes 12. The flutes 12, in turn, exert pressure against the skin of a user.

It has been found effective to make the fitting 11 in the dimensional relationships illustrated, of a silicone material in three different sizes. A larger diameter size is for adults having a larger outer ear channel, the medium size is for other adults, and the smaller size is for children and those adults having a comparatively narrower ear channel. The safety passages 14 carry environmental sound into the outer ear channel improving safety of a wearer.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A method of audio sound propagation, the method comprising:

providing a speaker;

providing a fitting comprising a sleeve having flutes extending therefrom and spaced from the sleeve, the flutes providing channels therebetween passing environmental sound waves through the fitting parallel to sound from the speaker;

the providing a fitting, wherein the flutes each form a combination by continuous and contiguous contact with a corresponding rib, each rib forming a continuous and contiguous contact with the sleeve, wherein the individual combinations are otherwise independent from one another except for their mutual connection to the sleeve;

fitting the sleeve around the shank; and inserting the fitting into an outer ear channel.

2. The method of claim 1, further comprising forming the fitting of a resilient material.

3. The method of claim 2, wherein the resilient material is a synthetic polymer.

4. The method of claim 3, wherein the polymer is an elastomeric polymer.

5. The method of claim 4, wherein the elastomeric polymer is a compound of silicone.

6. The method of claim 1, wherein the elastomeric polymer is an expanded polymer.

7. The method of claim 1, further comprising providing the ribs interconnecting the sleeve with the flutes, the sleeve, flutes, and ribs defining a plurality of channels carrying sound waves parallel to the sound waves propagated from the speaker through the fitting.

8. The method of claim 7, wherein a pair of adjacent ribs form a channel defined by the pair, the sleeve, and an outer ear canal of a user.

9. The method of claim 8, wherein the channels are each characterized by at least one significant length limiting the frequency and wavelength of sound waves passed therethrough.

10. The method of claim 1, wherein the flutes are spaced apart equidistantly about the sleeve.

11. An apparatus, as an interface for an audio speaker, the interface fitting in an ear canal and comprising:

a sleeve fitted to a housing containing the speaker;

a plurality of fins extending radially from the sleeve and molded to be homogeneously formed therewith;

a plurality of flutes, circumferentially independent from one another and corresponding to the plurality of fins, each flute extending continuously and contiguously along substantially the entire axial length of a corresponding rib;

the ribs, flutes, and sleeve providing walls defining passages through the interface and conducting environmental sound waves axially therethrough parallel to audio sound waves generated by the speaker; and emanating along an interior lumen of the sleeve.

12. The apparatus of claim 11, wherein:

the flutes are formed homogeneously with the ribs and sleeve as a monolithic, integral unit of continuous and contiguous material material;

the flutes each form a combination by continuous and contiguous contact with the corresponding rib continuously and contiguously contacting the sleeve, wherein the individual combinations deflect independently from one another except for their mutual connection to the sleeve.

13. The apparatus of claim 12, wherein each adjacent pair of ribs forms with the sleeve a channel defining a path by which sound waves, propagated in an environment surrounding the speaker, pass parallel to the audio sound waves propagated by the speaker through the sleeve.

14. The apparatus of claim 13, wherein the flutes are sized and shaped to contact an interior surface of an ear canal of a user.

15. The apparatus of claim 14, wherein each rib is sized to deflect in response to a force applied thereto by an ear canal of a user, the each rib generating a pressure selected to not exceed a comfort level for a user.

16. The apparatus of claim 15, further comprising a rim interconnecting at least one of the ribs and the flutes along a circumferential direction of the fitting.

17. The apparatus of claim 11, further comprising a plurality of passages conducting sound waves originating in an environment surrounding the fitting to an ear canal of a user, the passages propagating therein environmental sounds substantially parallel to generated sound from the speaker passed through an interior of the sleeve.

18. The apparatus of claim 11, wherein the interface is formed of a flexible material and is sized and shaped to displace circumferentially a rib in response to loading by a wall of an outer ear canal of a user.

19. The apparatus of claim 11, wherein the sleeve, flutes, and ribs are homogeneously formed of a single material.

20. A method of bypassing a speaker system to introduce ambient sounds to a user, the method comprising:

selecting a speaker;

providing a fitting comprising a resilient elastomeric polymer homogeneously formed to present a sleeve portion, a plurality of ribs propagating radially from the sleeve portion, and a plurality of flutes, each passing along the entire axial length of a corresponding and respective rib of the plurality of ribs;

securing the fittings to the speakers;

applying an axial force along the direction of sound propagation from the speaker through the fitting into an ear canal of a user;

deflecting by at least one of the ribs, in at least one of a radial and a circumferential direction, locally and independently, without influencing directly the ribs adjacent thereto;

resisting, by at least one of the flutes, an effective radius of the fitting by local and independent deflection of a flute and corresponding rib in response to loading from an ear canal of a user; and propagating sounds from the speaker through the interior of the sleeve while propagating sounds from an environment surrounding the speaker through passages between adjacent ribs.

* * * * *